US005832542A

United States Patent [19]

Dominguez

[11] Patent Number: 5,832,542

[45] **Date of Patent: *Nov. 10, 1998**

[54] SUPPORT ASSEMBLY

[76] Inventor: Peter Robert Dominguez, 36 Trail Street, Wagga Wagga NSW 2650, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 637,652

[22] PCT Filed: Jul. 15, 1994

[86] PCT No.: PCT/AU94/00398

§ 371 Date: Apr. 29, 1996

§ 102(e) Date: Apr. 29, 1996

[87] PCT Pub. No.: WO95/02985

PCT Pub. Date: Feb. 2, 1995

[30] Foreign Application Priority Data

Jul. 23, 1993 [AU] Australia ..... PM0104

[51] Int. Cl.[6] ..... E03D 11/00

[52] U.S. Cl. ..... 4/254

[58] Field of Search ..... 4/254; 297/DIG. 10, 297/411.32, 411.4

[56] References Cited

U.S. PATENT DOCUMENTS

| | | | |
|---|---|---|---|
| 2,774,975 | 12/1956 | Frank | 4/254 |
| 3,474,471 | 10/1969 | Matibag | 297/411.321 |
| 3,574,242 | 4/1971 | Trowbridge | 4/254 |
| 3,969,778 | 7/1976 | Richards | 4/254 |
| 4,196,480 | 4/1980 | Guenther et al. | 4/254 |
| 4,343,052 | 8/1982 | Guenther | 4/254 |
| 4,715,069 | 12/1987 | James | 4/254 |

FOREIGN PATENT DOCUMENTS

| | | | |
|---|---|---|---|
| B3-53775/79 | 3/1980 | Australia . | |
| A1-70 199/81 | 11/1981 | Australia . | |
| A-10290/83 | 7/1983 | Australia . | |
| 0 057 543 | 8/1982 | European Pat. Off. . | |
| 0 452 072 | 10/1991 | European Pat. Off. . | |
| 7303003 | 9/1973 | France . | |
| 2627372 | 8/1989 | France | 4/254 |
| 89 13504 | 4/1991 | France . | |
| 0485217 | 10/1929 | Germany | 297/411.32 |
| 42 04 454 | 7/1993 | Germany . | |
| 9005477 | 5/1990 | WIPO | 4/254 |

*Primary Examiner*—Charles E. Phillips
*Attorney, Agent, or Firm*—Michael D. Bednarek; Kilpatrick Stockton LLP

[57] ABSTRACT

A toilet support assembly for supporting a disabled user is described having base support means (16, 17, 18) for supporting the toilet support assembly relative to the toilet; user support means (14, 15) mounted to the base support means and moveable between an operative position in which the user support means is engageable by a user of the toilet to support the user and an inoperative position, and position limiting means (26, 27) for limiting the movement of the user support means relative to the base support means to locate the user support means in the operative position.

10 Claims, 5 Drawing Sheets

SUPPORT ASSEMBLY

TECHNICAL FIELD

This invention relates to a support assembly.

The invention has particular but not exclusive application to a support assembly for supporting an invalid of physically disadvantaged person during movement to and from a seated position or in a standing position and for illustrative purposes reference will be made to such an application. However it will be realised that the invention has wide-ranging application and can be used by other than invalids and physically disadvantaged persons.

BACKGROUND ART

As the average age of the population increases, the number of carers of frail aged persons who are themselves aged also increases. This is because public health authorities in attempting to lower the increasing public health cost of geriatric care, are encouraging and assisting a healthy partner of a frail or invalid aged person to care for the person at home rather than admitting the person to an institution.

Toilet, shower and bath supports for invalids and physically disadvantaged persons are well known. However known support assemblies indicated above can cause distress, undue hardship and even injury to the healthy carer when themselves using a toilet or shower with known supports in place or when attempting to move such support assemblies. This can mean that two aged and infirm persons may require institutionalised care rather than only one, and overall this will significantly increase the cost of public health.

SUMMARY OF INVENTION

The present invention aims to provide an alternative support system which will be reliable and efficient in use. This invention in one aspect resides broadly in a support assembly for supporting a user when using a seating facility, the support assembly including:

base support means for supporting the support assembly on the facility, the base support means being supported by the facility in stable equilibrium;

user support means mounted to the support assembly and moveable between an operative position in which the user support means is engageable by a user of the facility to support the user and an inoperative position, and position limiting means for limiting the movement of the user support means relative to the base support means to locate the user support means in the operative position.

It is to be understood that references herein to the use of or using a facility, are to be construed in a wide sense and include gaining access to and from the facility as well as actual use thereof. Thus for example a toilet support assembly is operative to provide support for a person not only when the toilet is being used by the person but also and particularly when the person is lowering or raising him- or herself onto and off the toilet. It is preferred that the user support means is pivotally mounted to the base support means and the position limiting means are abutments located on the user support means and adapted to abut the base support means.

The base support means may be permanently fixed to the facility but it is preferred that the base support means is releasably affixable to the facility. The support surface may be attached to or supported on the facility at a single location such that a load applied to the support assembly during use by a user of the facility is transmitted to the facility at only that location. However to provide a distributed loading it is preferred that the support assembly includes a plurality of spaced bearing surfaces adapted to juxtapose spaced surfaces on the facility.

The support assembly is suitable for use with many facilities. By way of example only, the facility can be a shower cubicle, a bath or a bus or car seat. In a preferred embodiment the facility is a toilet bowl having a seat, lid and releasable fastening means fixing the lid and seat thereto, one of the bearing surfaces is a central plate member releasably affixable to the toilet bowl by the fastening means, and the other bearing surfaces are rigidly affixed to the central plate member and adapted to bear on opposite sides of the rim of the toilet bowl.

Suitably the other bearing surfaces are supported on arms extending from the central plate around the upper portion of the toilet bowl. A slight gap may be formed between the arms and the outer edge of the upper portion of the toilet bowl for receiving therein stabilising means for stabilising a so-called bubble seat placed on a conventional toilet to elevate the user.

The central plate member can be customised to suit a particular toilet. However it is preferred that the central plate member includes a plurality of apertures for receiving the fastening means therethrough whereby the assembly is adaptable for use with a range of toilets.

The user support assembly can be a single arcuate or looped arm adapted to partially or completely encircle or surround a user. However preferably the user support assembly includes a pair of arms independently and pivotally mounted to the base support means.

The arms may be square tubing having a rounded tube sleeving in a portion adapted to be pivotally mounted in a sleeve on the base support means. However it is preferred that the arms are cylindrical and the base support means includes sleeve means for pivotally mounting the arms thereon. The arms may be internally threaded at their ends for receiving end caps or other members custom designed to cater for individual or certain physical disadvantages.

The arms can be removable from the sleeve mountings but it is preferred that the position limiting means prevent disengagement of the arms from the sleeve means. Suitably the position limiting means are attached to the arms to capture the sleeve means.

In another aspect this invention resides broadly in a toilet support assembly for supporting an aged, infirm, invalid or disadvantaged user of a toilet having a toilet bowl, seat, lid and releasable fastening means fixing the lid and seat to the bowl, the toilet support assembly including:

a base support frame for releasably supporting the toilet support assembly on the toilet bowl;

user support means pivotally mounted to the base support means and pivotable between an operative position in which the user support means is engageable by a user of the toilet to support the user and an inoperative position, and position limiting means for limiting the movement of the user support means relative to the base support means to locate the user support means in the operative position.

The base support frame may include a central plate member releasably affixable to the toilet bowl by the fastening means, a pair of arms extending from the central plate around the upper portion of the toilet bowl and having respective bearing surfaces adapted to bear on opposite sides of the rim of the toilet bowl.

Preferably the central plate member includes a plurality of apertures for receiving the fastening means therethrough. The user support assembly may include a pair of cylindrical arms independently and pivotally mounted to the base support means in sleeve means, the position limiting means preventing disengagement of the cylindrical arms from the sleeve means.

The arms may include end portions pivotal between an extended position for normal use and a lockable inwardly angled position where the distal ends of the respective end portions substantially abut to form a supporting barrier for preventing an invalid or frail aged user falling from the toilet during use thereof.

DESCRIPTION OF THE DRAWINGS

In order that this invention may be more easily understood and put into practical effect, reference will now be made to the accompanying drawings which illustrate a preferred embodiment of the invention, wherein.

DESCRIPTION OF THE PREFERRED EMBODIMENTS

Figure 8:
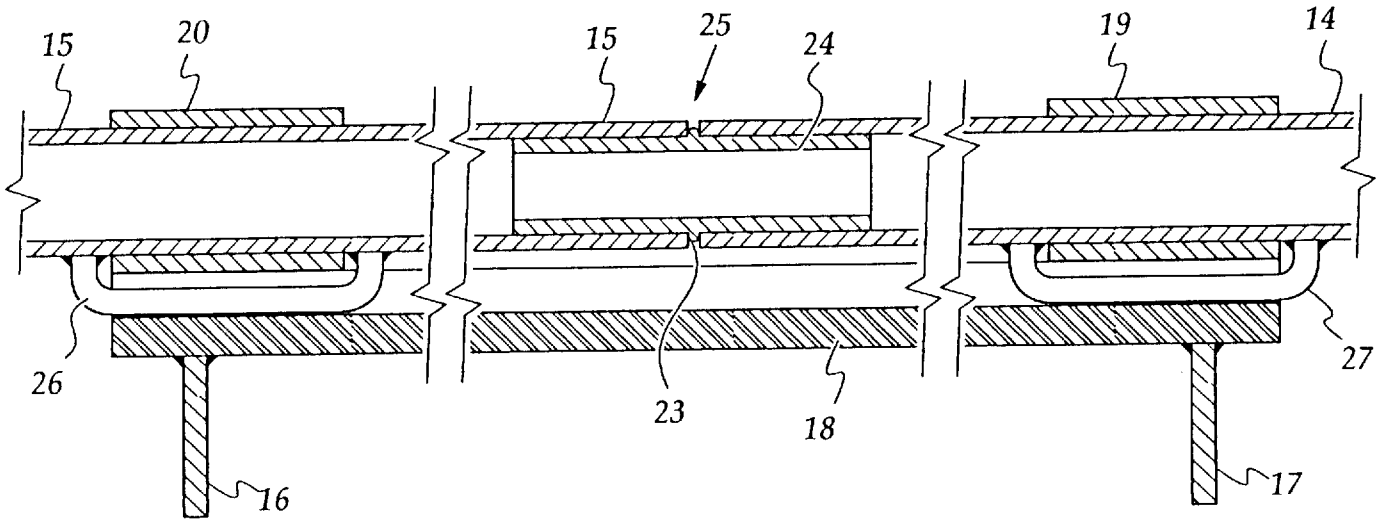
FIG. 8 is a cross-sectional elevation along lines AA of FIG. 7.

As can be seen in the drawings, a toilet support assembly 11 has a base support 12 and a user support 13. User support 13 comprises a pair of cylindrical tubular arms 14 and 15 bent through a right angle at one mounting end to form an end portion received in sleeves 19 and 20 on base support 12. Arms 14 and 15 are slightly angled at the other user support ends in a plane at right angles to that formed by the arm and the mounting end to form handles 21 and 22 which can be grasped by a user for support. Arms 14 and 15 are pivotally co-located at 25 by an internal axle 24 best seen in FIG. 8. The external diameter of axle 24 is such to form a close fit within the internal diameter of the tubing constituting arms 14 and 15. As can be seen in FIG. 8 a small annular flange 23 is centrally located on the external surface of axle 24 to locate and retain axle 24 within both arms 14 and 15.

Figure 1:
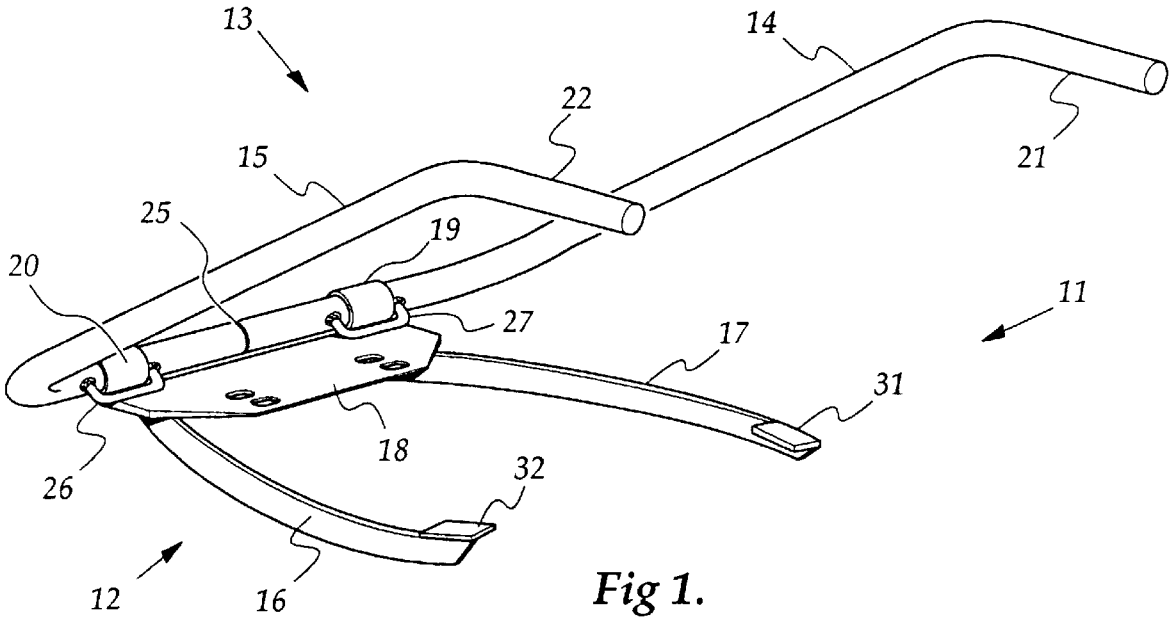
FIG. 1 is a perspective side view of a toilet support assembly with the arms in lowered position.
Figure 2:
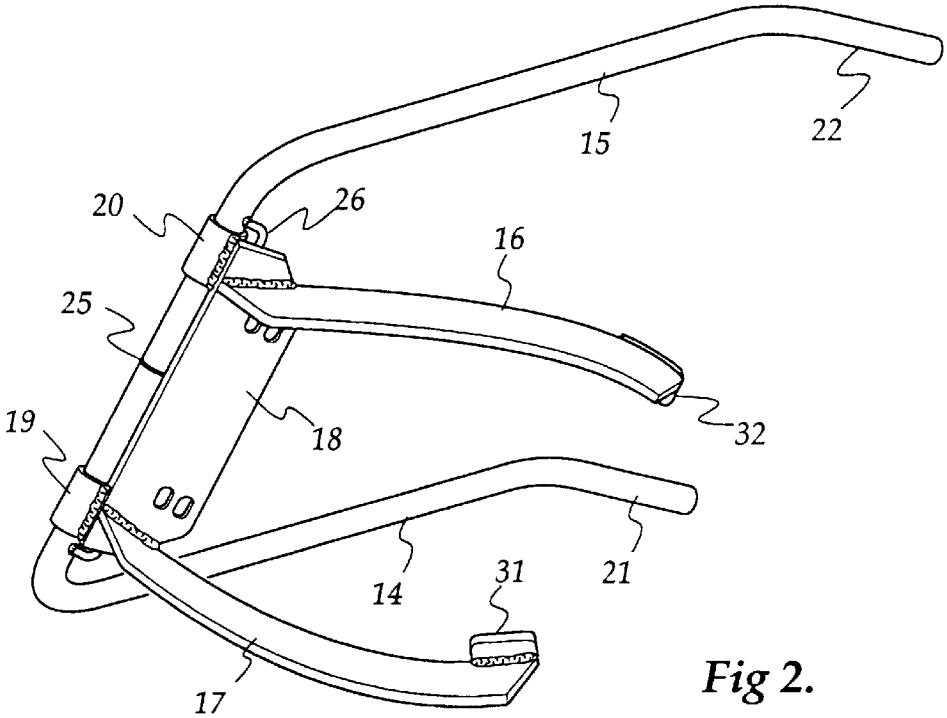
FIG. 2 is a perspective view of a toilet support assembly from below with the arms in lowered position.
Figure 3:
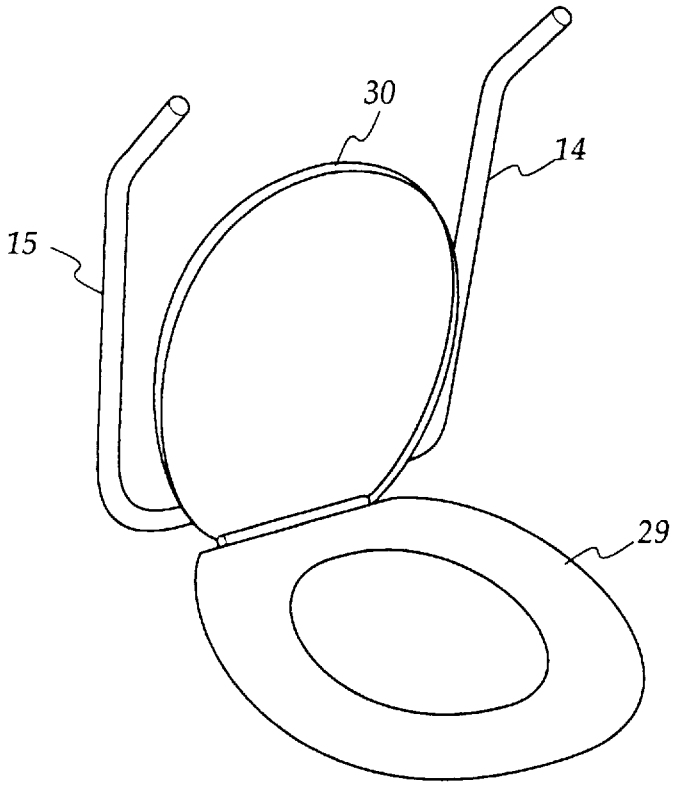
FIG. 3 is a perspective view of a toilet support assembly attached to a toilet seat and lid (but not showing the toilet bowl) with the arms in raised position.
Figure 4:
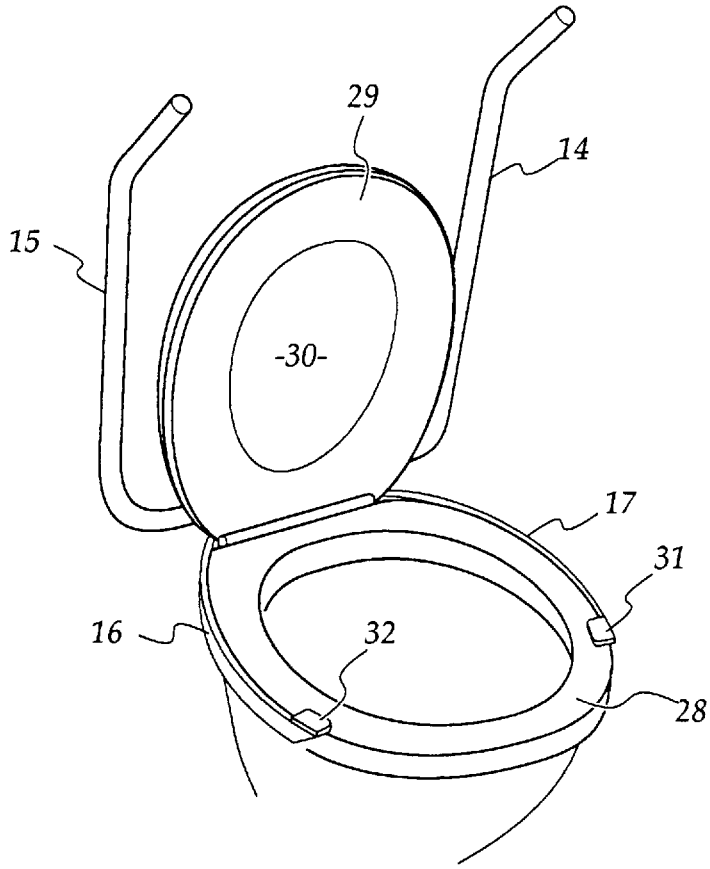
FIG. 4 is a perspective view of a toilet support assembly seen in FIG. 3 with the lid raised and illustrating the base frame arms extending around and supported on the lid of the toilet bowl.
Figure 7:
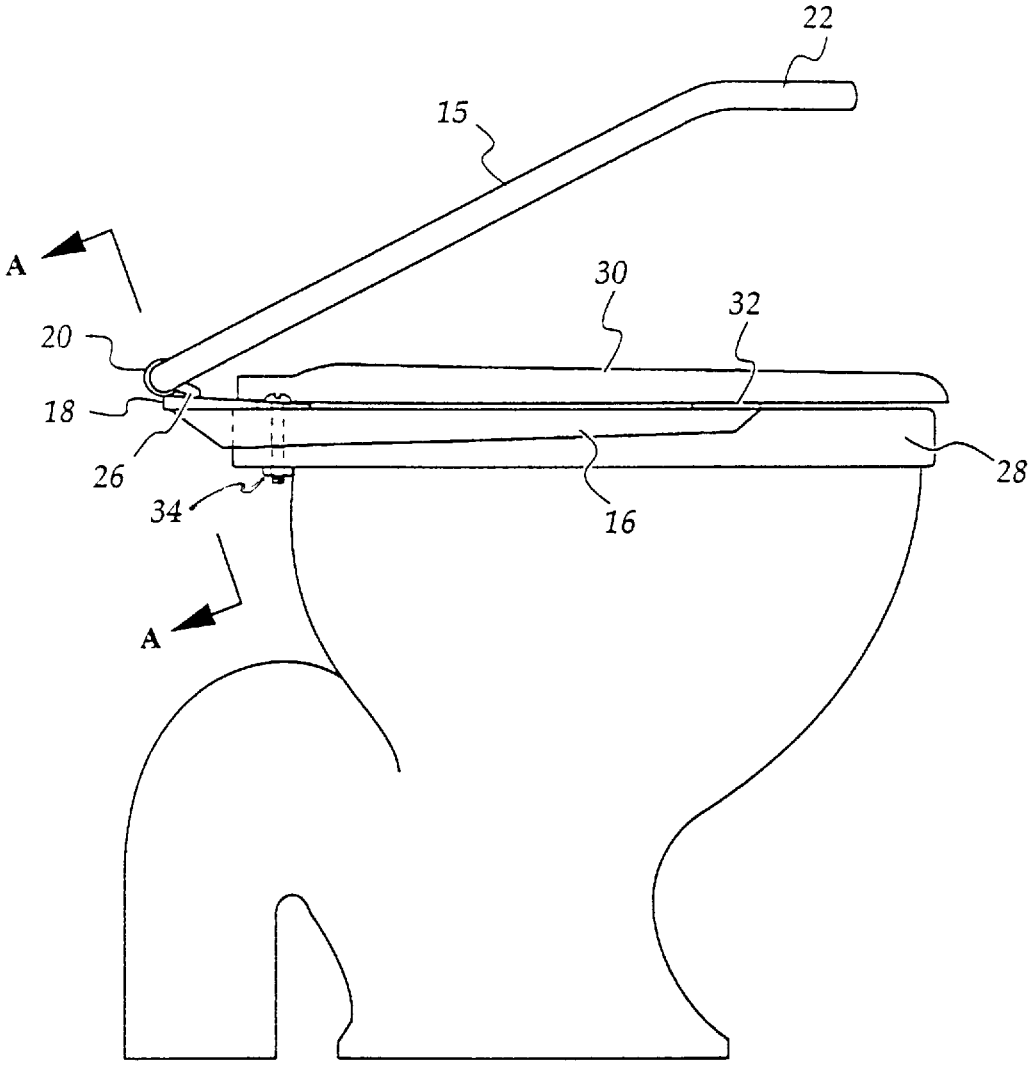
FIG. 7 is a side elevation of a support assembly affixed to a toilet.

Base support 12 comprises a yoke-like frame having arcuate arms 16 and 17 extending from a central plate 18. Sleeves 19 and 20 are fixed to the base support proximate the rear edge of central plate 18 opposite arms 16 and 17 and receive arms 14 and 15. Support lugs 31 and 32 are located at the end of arms 16 and 17 and as can be seen in FIG. 4, bear on the opposite sides of rim 28 of the toilet bowl having a seat 29 and lid 30 hinged together and connected to the toilet bowl in known manner by nut and bolt fasteners 34 as best seen in FIG. 7.

Arms 16 and 17 are contoured to follow the curve of the bowl. The arms are slightly flexible so that their angular disposition relative to central plate 18 is variable so that the support assembly has a degree of adjustability to enable it to fit a range of toilet bowls. The bolts of fasteners 34 pass through apertures 33 in central plate 18 to locate the assembly on the toilet with the central plate sandwiched between the upper rear surface of the bowl where the lid 30 and seat 29 are mounted and the mounting portion of seat and lid. As can be seen in FIG. 7, the thickness of plate 18 tapers in the direction away from the rear edge to provide an adaptability to configure with a range of toilets.

The support assembly is preferably made from a suitably strong stainless steel and the various parts welded together as is best seen in FIG. 8. A suitable plastics material can also be used.

Figure 5:
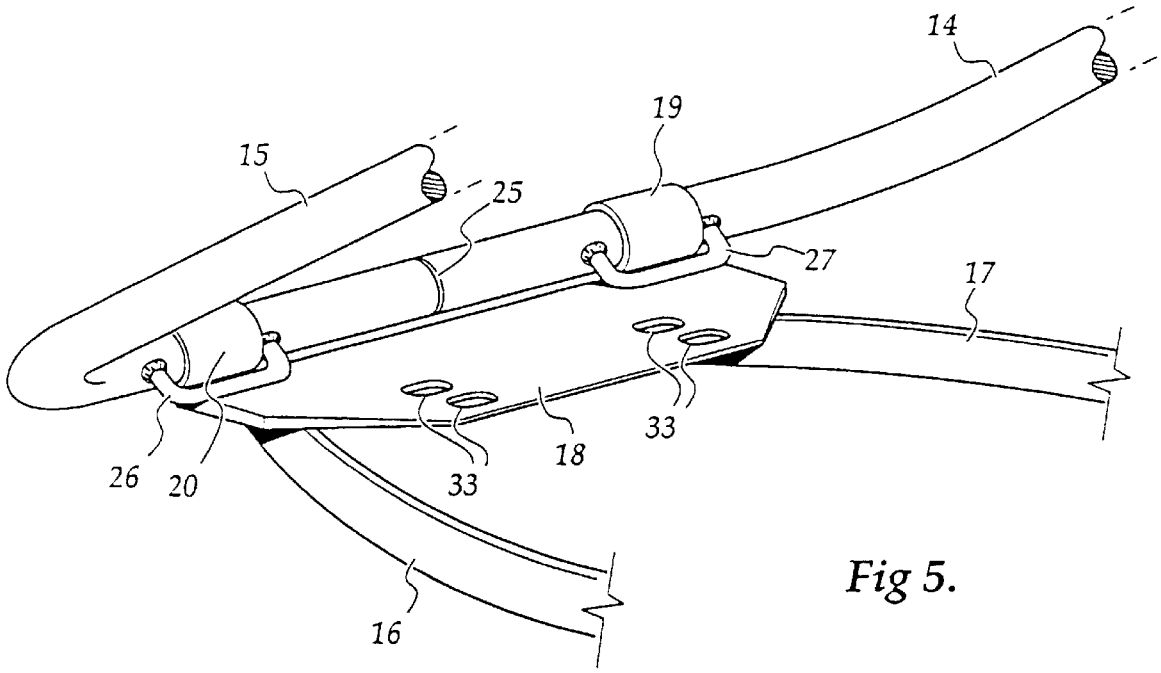
FIGS. 5 and 6 are detailed perspective views of the mounting of the support arms to the base assembly showing in FIG. 6 one of the arms raised.
Figure 6:
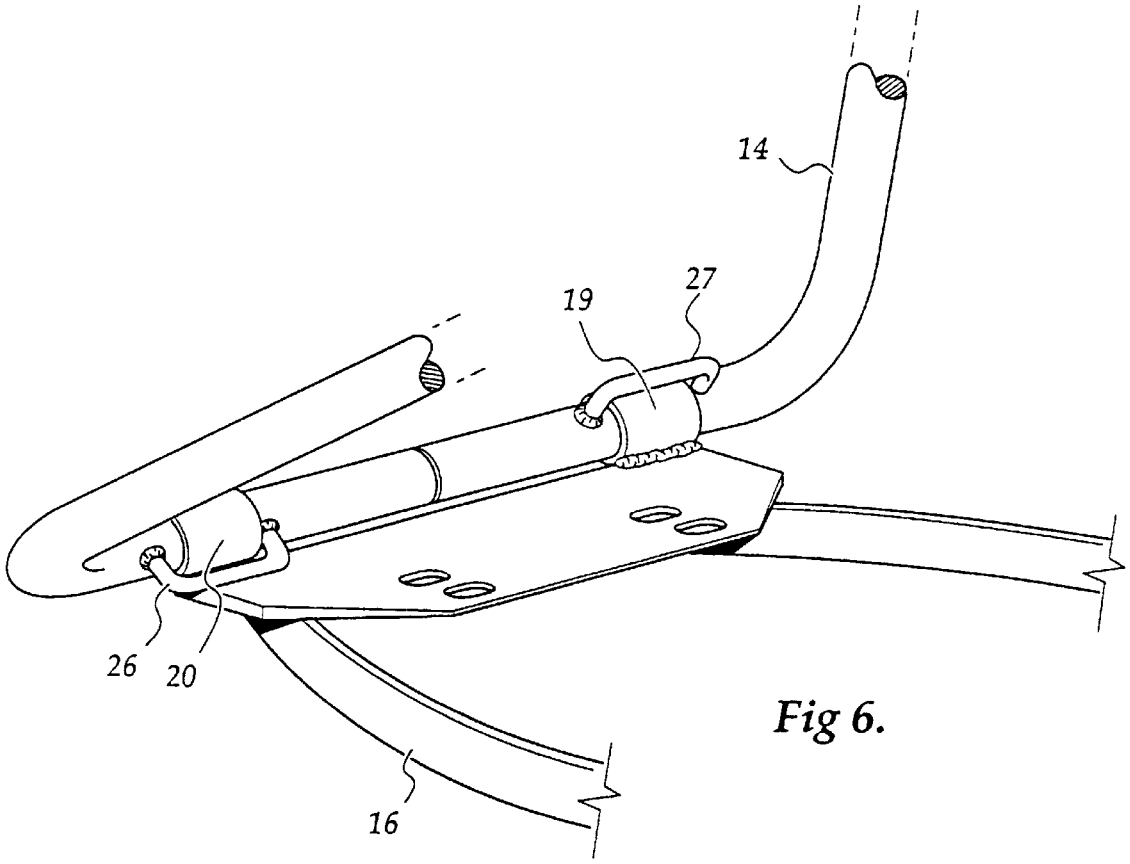

Rotational movement of user support arms 15 and 16 with respect to base support 13 is limited by a pair of abutment lugs 26 and 27. As is best seen in FIGS. 5 and 6, lugs 26 and 27 are fixed to arms 14 and 15 by, in the case of a stainless steel support, welding. The lugs are welded to the arms on either side of sleeves 20 so that the arms cannot accidently be removed from the assembly or become disengaged therefrom during use. Alternatively in a manner not illustrated, the lugs can be welded to the arms at only one location to form a cantilevered abutment lug and, if connected to the arm so that the open end of the cantilever faces the mounting end of the arm, the arm can be removed from the assembly if required.

The toilet support assembly is simply installed for use by removing the nuts or other fasteners holding the toilet seat/lid assembly to the toilet bowl, locating central plate 18 on the rear support of the toilet bowl, aligning apertures 33 with the fasteners, repositioning the seat/lid assembly and tightening the fasteners. In use the load exerted by a person leaning on or otherwise supporting themselves on arms 14 and 15 is transferred to plate 18 through lugs 26 and 27 and to support lugs 31 and 32 through arms 16 and 17 thereby distributing the load around the toilet bowl. This distribution also provides stability.

It will be realised that the support assembly in accordance with the invention is simple to operate and install without the need for structural modifications. The expense of installation is minimal. The support assembly improves on known toilet supports in being easily transferable between locations and because the support assembly is light, non-bulky and easily assembled, users can thus travel and take the support with them. Because either arm can be raised independently of the other the support allows wheel-chair patients to approach a toilet from either side, whereas guard rails and the like are only useful if the guard rail is on the side of the good arm of the patient. The support is easily retracted to be out of the way of users not requiring support. Furthermore because there is no lower support or stand to impede the knees of a user, the support apparatus can be used if required by a person who can only be seated facing a toilet facing inwardly. The toilet support in accordance with this invention also enables a male user to stand and straddle the toilet bowl so that both hands can to be used to prevent a fall.

The support assembly improves on known toilet supports which are commonly bulky and cumbersome and detract from the aesthetic appearance of the bathroom, ensuite or toilet. The support assembly also improves on those known toilet supports which are permanently fixed in position and which hinder or make it awkward or difficult for the facility to be used by other users who are not invalided and physically disadvantaged. Furthermore, the support assembly also improves on known toilet support assemblies which are not permanent fixtures as these are commonly difficult and awkward to remove if the toilet is to be used by others without impediment or discomfort.

It will of course be realised that whilst the above has been given by way of an illustrative example of this invention, all such and other modifications and variations hereto, as would be apparent to persons skilled in the art, are deemed to fall within the broad scope and ambit of this invention as is hereinafter claimed.

I claim:

1. A support assembly for supporting a user when using a seating facility, said support assembly including:

base support means positionable on said facility and releasably affixable thereto, said base support means being fixedly supported by said facility in stable equilibrium and including a plurality of spaced bearing surfaces adapted to juxtapose spaced surfaces on said facility;

user support means pivotally mounted to and extending upwardly from said base support means adjacent said facility when said base support means is fixedly supported thereby and moveable between an operative position in which said user support means is engageable by a user of said facility to support said user and an inoperative position, and position limiting means for limiting the movement of said user support means relative to said base support means to locate said user support means in said operative position;

wherein said position limiting means are abutments located on said user support means and adapted to abut said base support means, and wherein said facility is a toilet bowl having a rim, seat, lid and releasable fastening means fixing the lid and seat thereto, one said bearing surface is a central plate member releasably affixable to said toilet bowl by said fastening means, and other said bearing surfaces are rigidly affixed to said central plate member and adapted to bear on opposite sides of the rim of said toilet bowl.

2. A support assembly as claimed in claim 1, wherein said base support means is releasably affixable to said facility.

3. A support assembly as claimed in claim 1, wherein said other bearing surfaces are supported on arms extending from said central plate around the upper portion of said toilet bowl.

4. A support assembly as claimed in claim 1, wherein said central plate member includes a plurality of apertures for receiving said fastening means therethrough.

5. A support assembly as claimed in claim 1, wherein said user support means includes a pair of arms independently and pivotally mounted to the base support means.

6. A support assembly as claimed in claim 5, wherein said arms are cylindrical and said base support means includes sleeve means for pivotally mounting said arms thereon.

7. A support assembly as claimed in claim 6, wherein said position limiting means prevent disengagement of said arms from said sleeve means.

8. A toilet support assembly for supporting an aged, infirm, invalid or disadvantaged user of a toilet having a toilet bowl, seat, lid and releasable fastening means fixing the lid and seat to the bowl, said toilet support assembly including:

base support means releasably and fixedly positionable on the toilet bowl;

user support means pivotally mounted to said base support means adjacent the toilet bowl when said base support means is fixedly supported thereon and pivotable between an operative position in which said user support means is engageable by a user of the toilet to support said user and an inoperative position, and position limiting means for limiting the movement of said user support means relative to said base support means to locate said user support means in said operative position;

wherein said base support frame includes a central plate member releasably affixable to said toilet bowl by said fastening means, a pair of arms extending from said central plate around the upper portion of said toilet bowl and having respective bearing surfaces adapted to bear on opposite sites of the rim of said toilet bowl.

9. A toilet support assembly as claimed in claim 8, wherein said central plate member includes a plurality of apertures for receiving said fastening means therethrough.

10. A toilet support assembly as claimed in claim 8, wherein said user support assembly includes a pair of cylindrical arms of independently and pivotally mounted to the base support means in sleeve means and said position limiting means prevents disengagement of said cylindrical arms from said sleeve means.

* * * * *